United States Patent [19]

McGourty

[11] 3,934,698

[45] Jan. 27, 1976

[54] CARRIAGE MECHANISM FOR PRINTER

[76] Inventor: Thomas K. McGourty, 1640 Cox Road, Aptos, Calif. 95003

[22] Filed: Feb. 1, 1974

[21] Appl. No.: 438,794

[52] U.S. Cl. ..... 197/90; 197/68; 197/85

[51] Int. Cl.[2] ..... B41J 19/20

[58] Field of Search ..... 197/48, 49, 68, 82, 84, 197/90, 85, 86, 87, 89, 96, 114, 120, 1 R; 346/76

[56] References Cited

UNITED STATES PATENTS

| | | | |
|---|---|---|---|
| 454,668 | 6/1891 | Steiger | 197/86 |
| 2,741,355 | 4/1956 | Dodge | 197/86 |
| 3,236,352 | 2/1966 | Schacht | 197/85 X |
| 3,365,200 | 1/1968 | Dollenmayer | 197/90 X |
| 3,519,115 | 7/1970 | Smith | 197/82 |
| 3,648,816 | 3/1972 | Marinoff | 197/82 X |
| 3,732,964 | 5/1973 | Inoue | 197/87 X |
| 3,759,362 | 9/1973 | Koch | 197/84 X |
| 3,819,028 | 6/1974 | Drillick | 197/82 |

*Primary Examiner*—Edgar S. Burr
*Assistant Examiner*—R. T. Rader
*Attorney, Agent, or Firm*—Robert G. Slick

[57] ABSTRACT

A simple carriage mechanism for a thermal printer or the like is provided wherein an escapement mechanism advances the printer from one character to the next.

1 Claim, 16 Drawing Figures

CARRIAGE MECHANISM FOR PRINTER

SUMMARY OF THE INVENTION

The present invention relates to a carriage mechanism for a printing unit wherein one character is printed at a time as the carriage is advanced and wherein it is necessary to advance the paper from one line to the next. The invention was particularly developed for use with a thermal printing unit but it will be obvious to those skilled in the art that the carriage mechanism could be used with other similar devices. Thus, the invention is broadly applicable to printers used in electronic calculators, terminal printers and similar mechanisms.

Thermal printers are well known to those skilled in the art and are typified by the unit sold by Texas Instruments under the designation EPN2100 and so the thermal printer and decoder head and thermal paper will not be described.

Typical printers print one character at a time so that it is necessary to advance the printing head from left to right as the characters are printed and to advance paper by one line and return the carriage to its left hand position at the end of each line. Conventional electronic data inputs provide alternating pulses between each character and also a line feed pulse at the end of each line and the printer of the present invention utilizes these pulses to advance the printing head from character to character and the paper from line to line.

The carriages for thermal printing heads which have been used in the past have been relatively expensive and have ordinarily used stepping motors. In contrast, the device of the present invention utilizes an ordinary inexpensive motor to actuate the head.

A further disadvantage of thermal printer carriages used in the past is that the stepping motor is relatively bulky as well as expensive and has a high power consumption and requires an expensive logic circuit to drive the stepping motor.

A still further object is to provide a carriage of low power consumption and wherein the main power for actuating the mechanism does not pass through the logic circuits.

Thus, an object of the present invention is to provide an inexpensive mechanism for advancing a thermal print head which does not require a stepping motor.

A further object of the invention is to provide a simple, yet positive mechanical structure which is inexpensive to manufacture, requires little maintenance and is of small size.

Other objects and advantages of the present invention will be brought out later in the specification.

BRIEF DESCRIPTION OF THE DRAWINGS

In the drawings forming part of this application.

DESCRIPTION OF THE PREFERRED EMBODIMENTS

Figure 1:
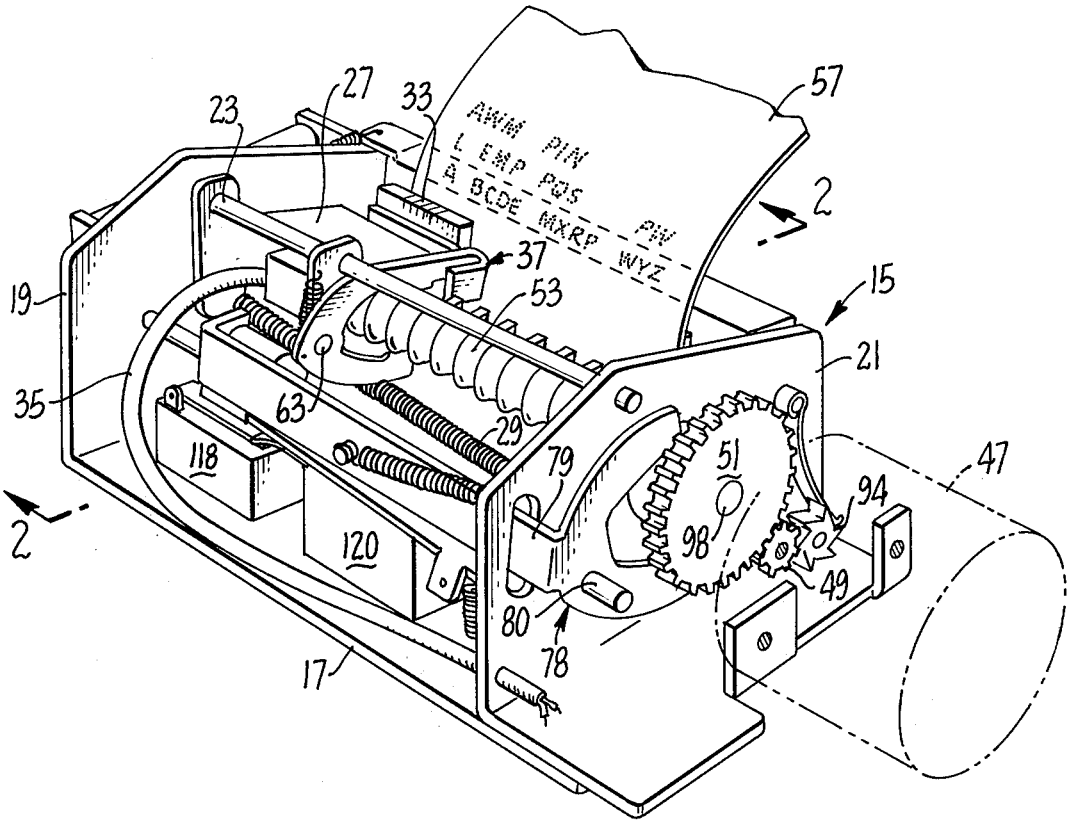
FIG. 1 is a perspective view of a printer embodying the present invention.
Figure 2:
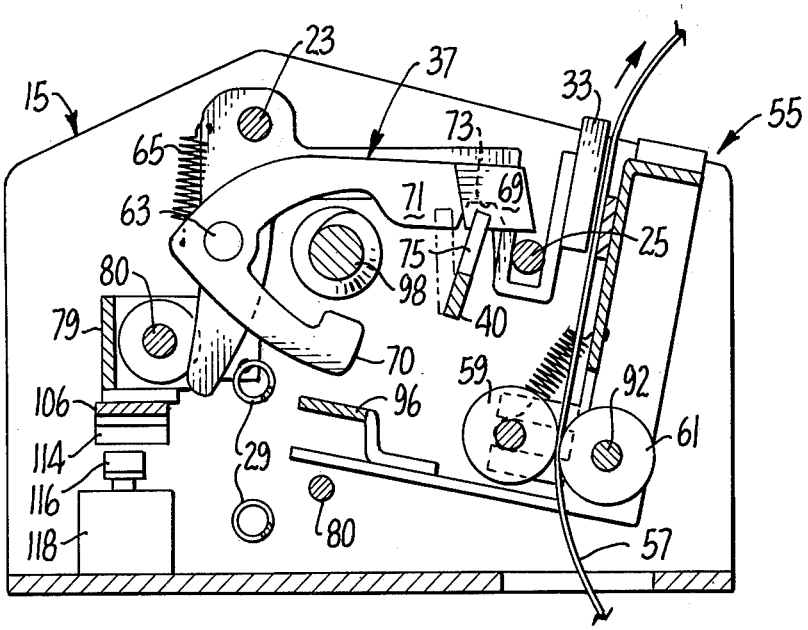
FIG. 2 is a section on the line 2—2 of FIG. 1.
Figure 3:
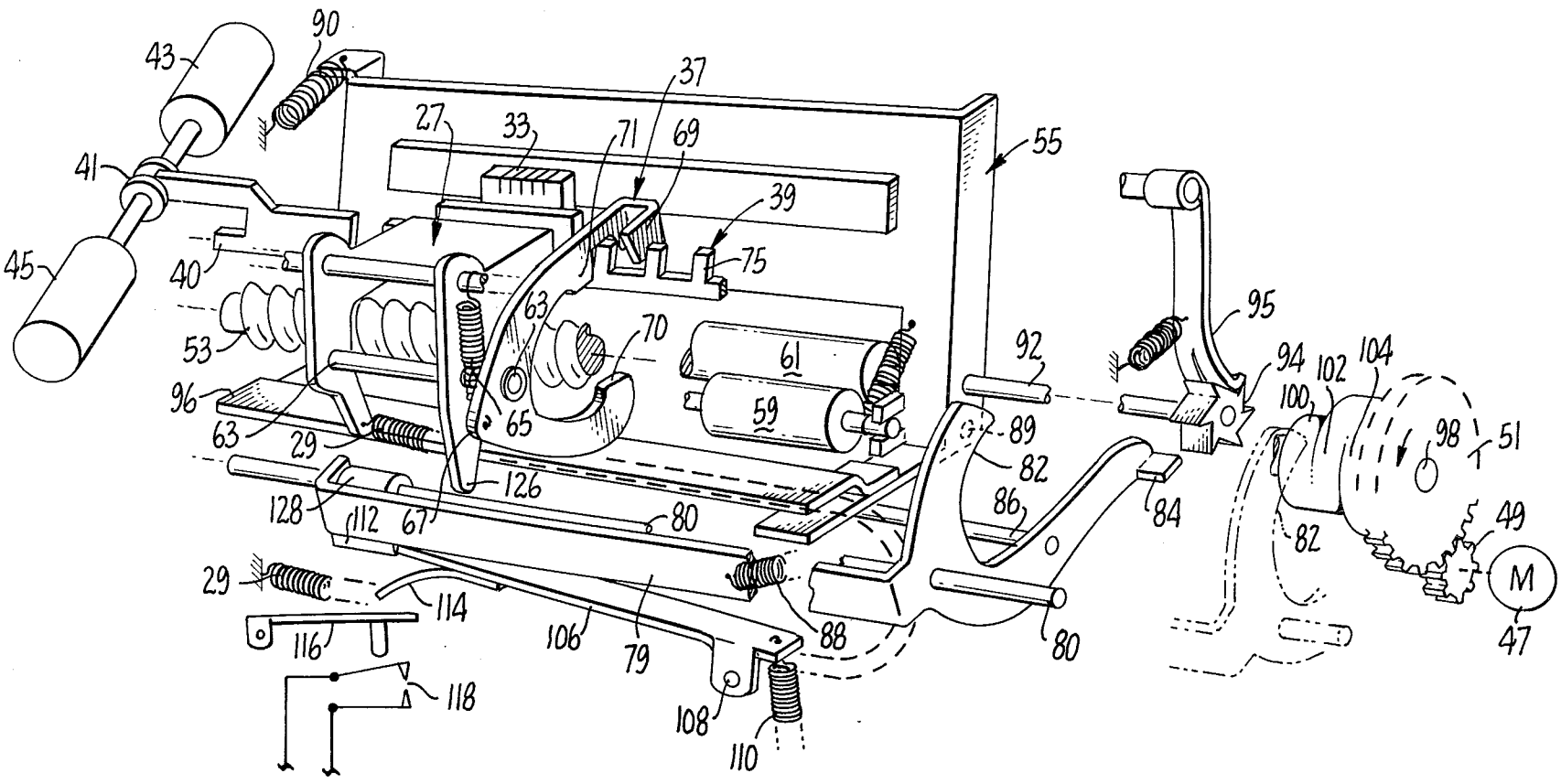
FIG. 3 is an exploded view of the printer with certain parts cut away to better illustrate the mechanism.
Figure 4:
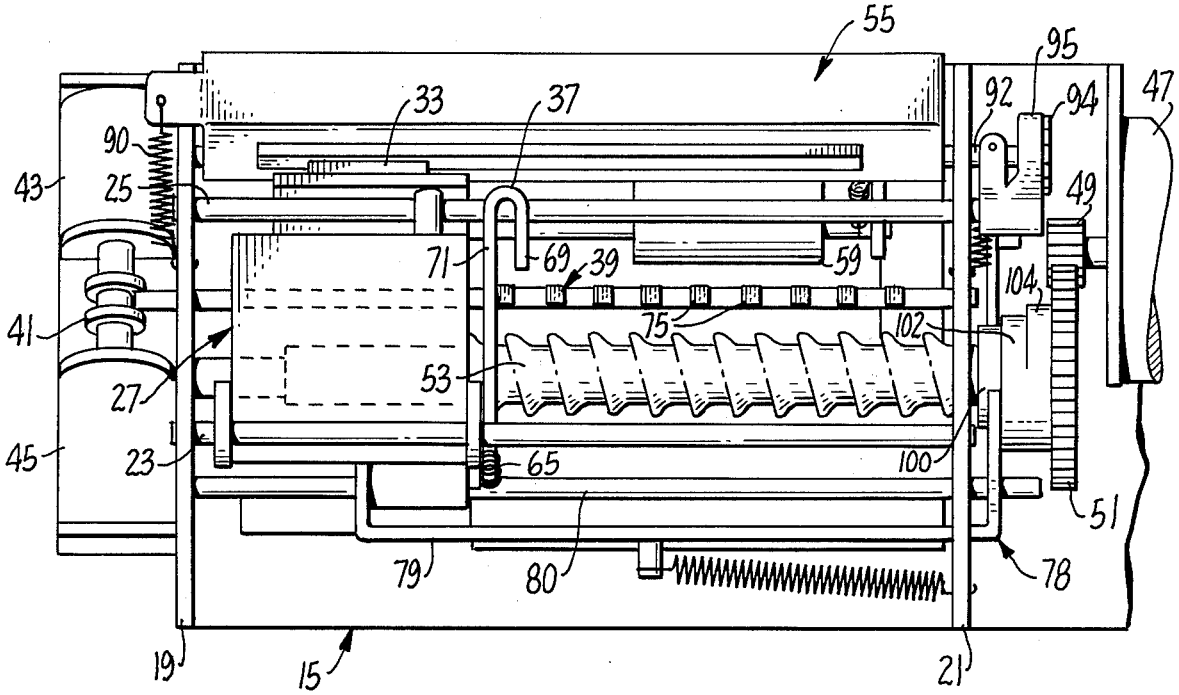
FIG. 4 is a top view of the printing carriage of the present invention.
Figure 5:
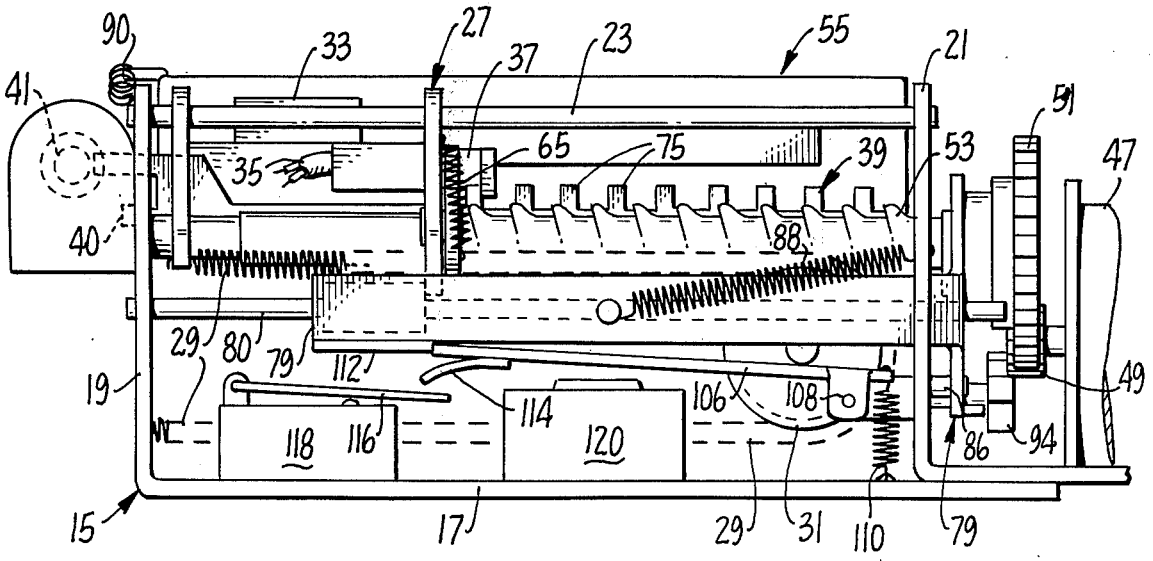
FIG. 5 is a front view of the device shown in FIG. 4.
Figure 6:
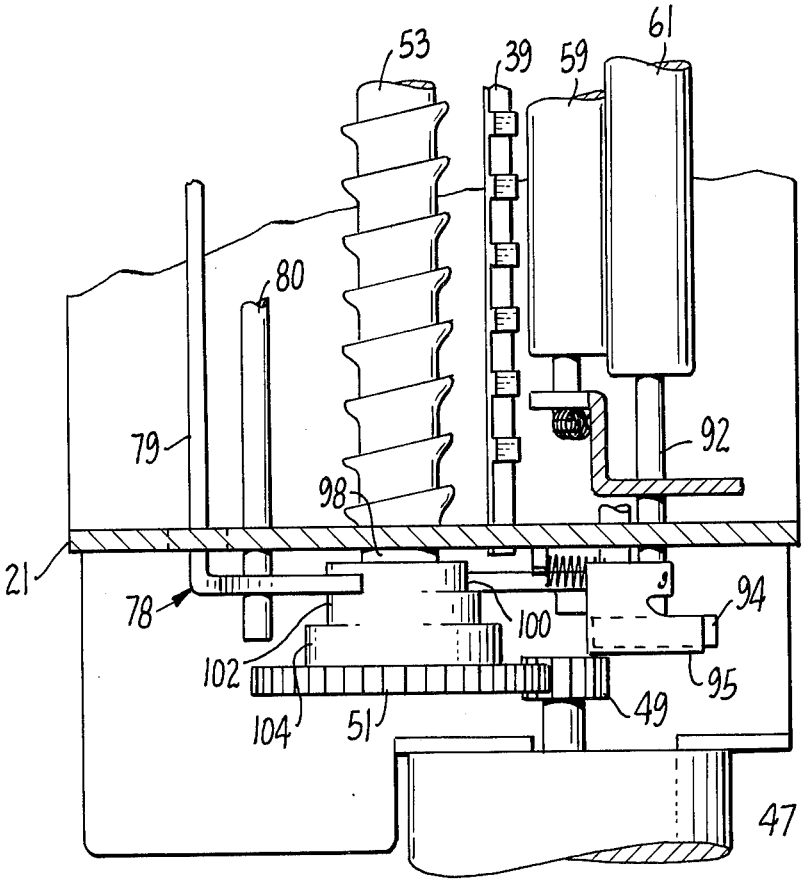
FIG. 6 is a partial enlarged view of the drive end of the mechanism.
Figure 7:
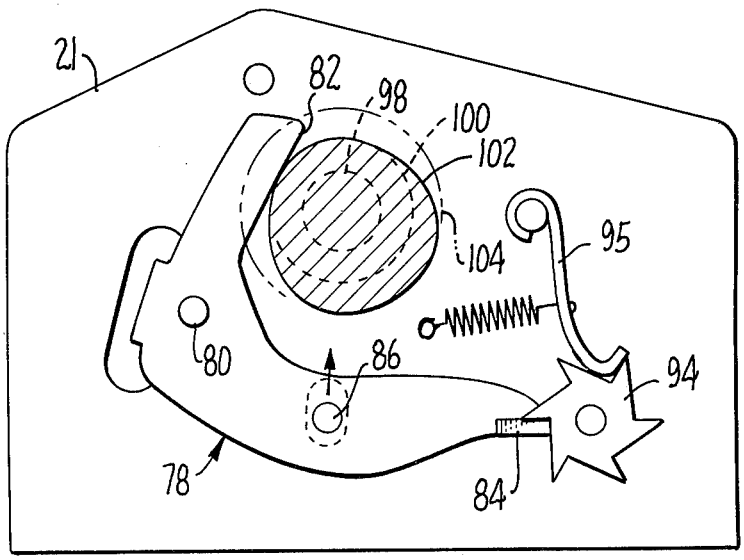
FIG. 7 is a section view, particularly showing the action of the paper advance.
Figure 8:
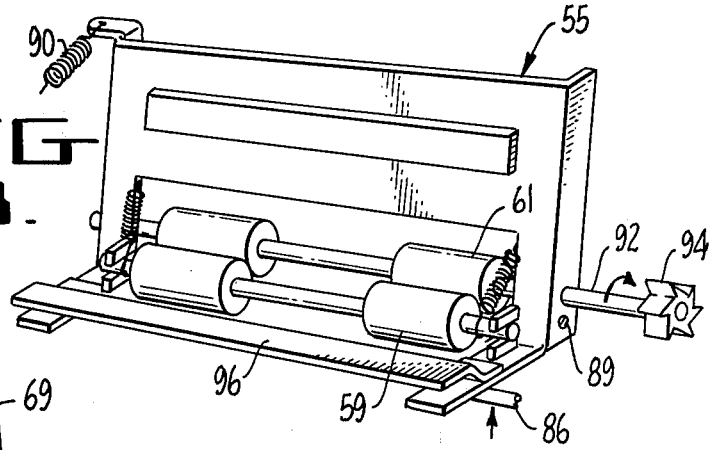
FIG. 8 is a partial view showing the platen and paper drive mechanisms.

The overall operation of the thermal printing device will first be described with particular reference to FIGS. 1, 2 and 3 and the specific details of operation will be later described.

The printer includes a fixed frame generally designated 15 having a base 17 and end plates 19 and 21. Shaft rails 23 and 25 extend from one end plate to the other and on these rails a carriage 27 is slideably mounted. A spring 29 passing around a spring pulley 31 biases the carriage to the right. Carriage 27 carries the thermal printing head 33. The thermal printing head carries its own decoding logic and the electric impulses for actuating the thermal printer are carried to the head through the multiple wire cable 35. Carriage 27 carries a pawl 37 which has two faces and which moves along rack 39. The rack is pivoted at 40 for back and forth motion through a limited arc to two positions. Plunger 41 actuated by solenoids 27 43 and 45 move the rack between the two positions. Carriage 27 moves stepwise to the right by means of spring 27 and by alternate pulses to solenoids 43 and 45. An electric motor, shown in skeleton form at 47 drives gear 49 which in turn drives gear 51 which is mounted on shaft 98 carrying a worm 53. Mounted behind the carriage 27 is a platen generally designated 55. Thermal paper 57 from a source, not shown, passes between idler rollers 59 and drive rollers 61 upwardly through the machine between the printing head 33 and the platen 55. At the end of a line a pulse from the logic mechanism turns on the motor and causes the pawl 37 to engage the worm 53, advances the paper one line and returns the carriage to the left for a repetition of the cycle.

Having described the overall operation of the machine, a detailed description now will be given of the various individual parts.

Figure 9:
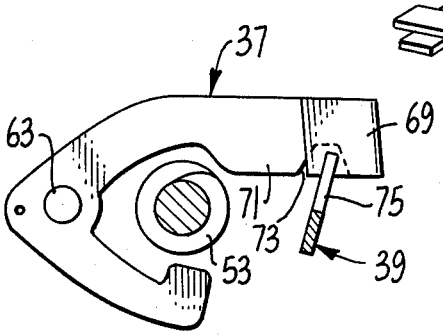
FIG. 9 is an enlarged partial view of the escapement mechanism.
Figure 10:
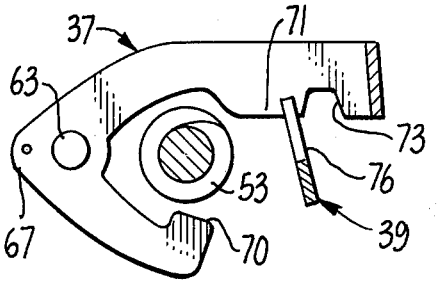
FIG. 10 is a view similar to FIG. 9 showing the further action of the escapement mechanism.
Figure 13:
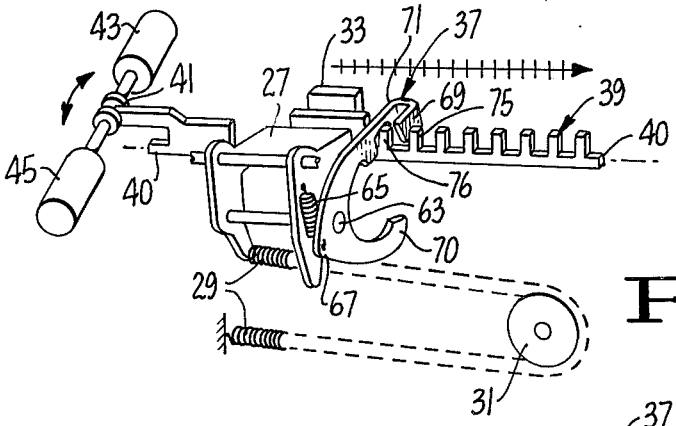
FIG. 13 is a diagram showing the action of the escapement mechanism.
Figure 14:
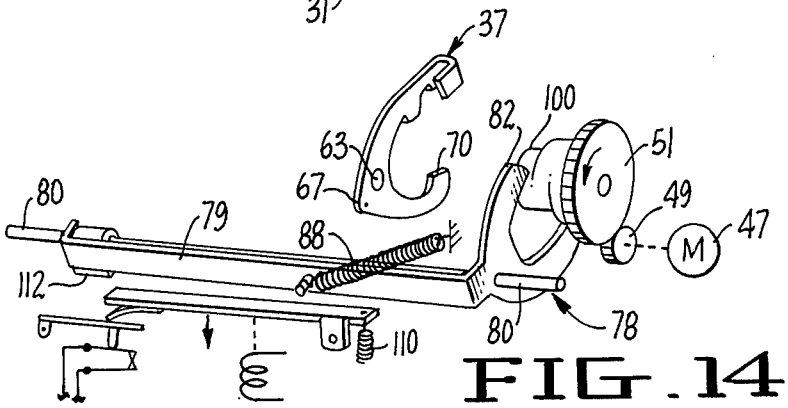
FIG. 14 is a diagram showing the action at the end of a line just before the paper is advanced.
Figure 15:
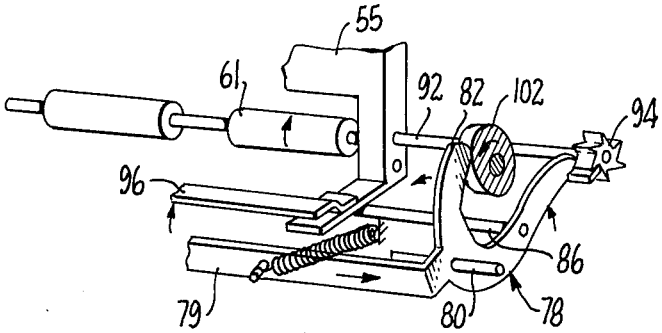
FIG. 15 is a diagram showing the action of the paper advancing mechanism.
Figure 16:
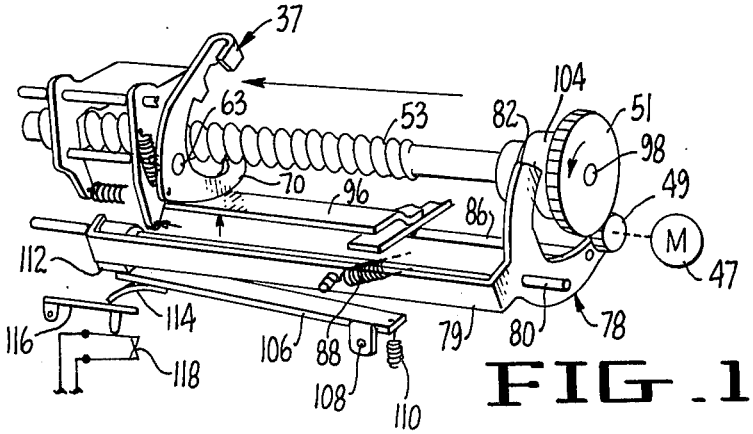
FIG. 16 is a diagram showing the action during the head return motion.

Carriage 27 carries the C-shaped pawl 37 which is pivoted on pin 63 and is biased in a clockwise direction by spring 65 which is connected between the frame of the carriage and arm 67 which extends from the pawl adjacent the pivot point. The top arm of the C-shaped pawl is bent into a U configuration to form two faces, namely, 69 and 71. Adjacent face 71 has a notch 73 of sufficient depth to clear the teeth 75 on rack 39. The teeth 75 on rack 39 are spaced by an amount equal to twice the width of a character while the separation between the faces 69 and 71 on pawl 37 is equal to the space of one character. Pawl 37 also has a lower face 70, the purpose of which will be later explained. The stepwise motion of the carriage can now be readily understood, particularly by reference to FIGS. 9, 10, and 13. Spring 29 is urging carriage 27 to the right but its motion is normally stopped by one or the other of the upper faces on pawl 37, since pawl 37 is biased in a clockwise direction by spring 65. For instance, in FIGS. 9 and 13, tooth 75 is being held against the face 69. If solenoid 45 is pulsed, the rack will pivot forward and now the next adjacent tooth 76 will engage on face 71. This action is shown in FIG. 10. As was pointed out previously, the distance between faces 69 and 71 is equal to the character spacing, while the space between adjacent teeth on the rack is twice this. Thus, by alternately pulsing solenoids 43 and 45, the carriage proceeds stepwise to the right, one character space at a time. In the embodiment illustrated, the rack has eight teeth so that a 16 character line can be printed but it is obvious, of course, that a smaller or larger number might be used.

When the carriage reaches the right hand extremity of its path, it is necessary to do three things, namely, advance the paper by one line, release the pressure on the platen and return the carriage to its left hand extremity, ready for the printing of the next line. The method accomplishing these particular motions will now be described.

A bell crank generally designated 78 having an arm 79 is mounted on shaft 80 which is attached to the framework of the machine and the bell crank is free to rotate and slide on shaft 80. The bell crank has one end formed as a cam follower 82 while the opposite end has a paper feed pawl 84 thereon and near the center the bell crank has a stud 86 extending therefrom. The bell crank is biased to the right by means of spring 88.

The platen assembly 55 is mounted for rotation on pivot 89 and is normally biased in a counterclockwise direction by means of spring 90, i.e., the spring holds it against the printing head 27 with paper therebetween. The platen assembly carries the paper feed rollers 61 and the idler rollers 59. The feed rollers are mounted on a shaft 92, having a sprocket 94 on the end thereof wherein the number of teeth on the sprocket is such that advancing sprocket 94 one tooth will advance the paper by one line. Pawl 95 prevents reverse rotation and insures accurate line spacing. Platen 55 carries a bar 96 which extends across the entire width of the platen while the bell crank stud 86 extends under the platen. Thus, the spring 90 will normally hold the platten against the thermal printing head in the normal printing position but if the bell crank is rotated, stud 86 will raise bar 96 rotating the entire platen assembly, freeing the paper from pressure between the platen and the printing head.

Worm 53 is mounted for rotation on the frame of the machine and passes through the carriage assembly while the C-shaped pawl 37 is mounted so that the worm passes between its arms. The worm is mounted on a shaft 98 which is attached to gear 51 previously described. At the end of the worm is a cam assembly which has three faces, namely, a low concentric face 100, a cam lobe 102 and a high concentric face 104. The lowest point of lobe 102 corresponds with the diameter of face 100 while the highest point of lobe 102 corresponds with the high concentric face 104.

Mounted on the frame of the machine is a clutch arm 106 which is pivoted near one end at 108 and biased in a clockwise direction by means of spring 110. The clutch arm lies directly below the arm of bell crank arm 79 and adjacent to a projection 112 on the bottom of the arm of the bell crank. An arm 114 projects below the clutch arm and can engage the lever 116 of switch 118. Also mounted under the clutch arm is a solenoid magnet 120 which can be energized from a power source 122 by closing switch 124. The position of the parts is such that switch 118 can be closed by energizing solenoid 120 and is kept closed if the projection 112 is lying over the clutch arm even when the solenoid is deenergized. Motor 47 is on at all time when switch 118 is closed.

Figure 11:
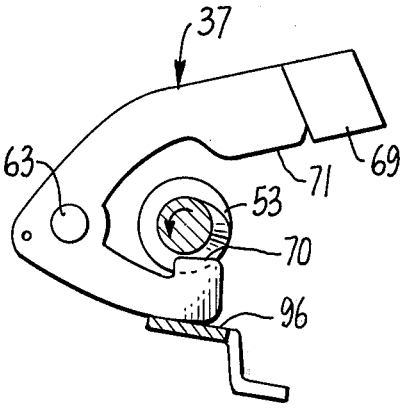
FIG. 11 is a view similar to FIG. 9 showing the pawl action during the printing head return.
Figure 12:
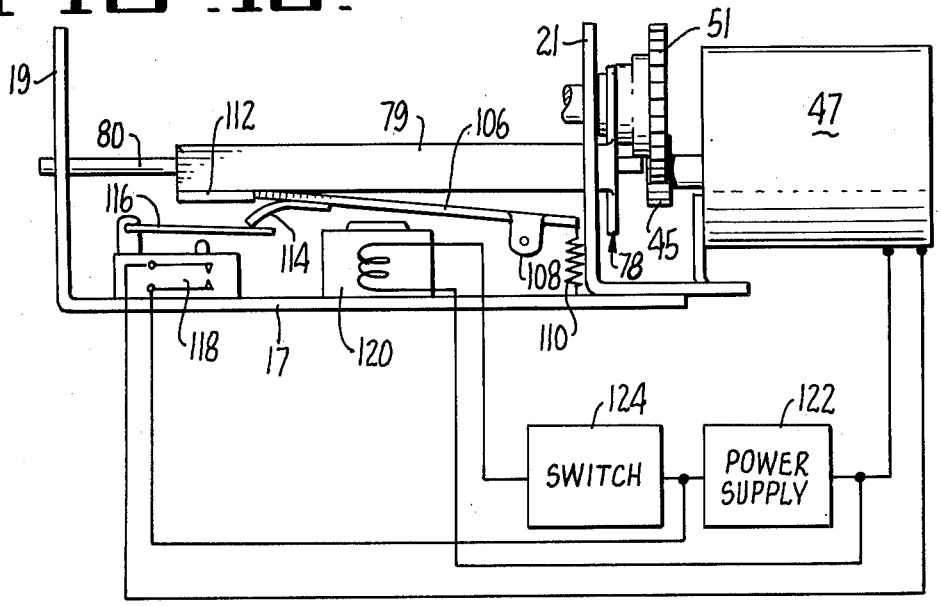
FIG. 12 is a wiring diagram illustrating the motor actuating switch.

When the carriage reaches its right hand path of travel, switch 124 is closed. This energizes solenoid 120 bringing arm 106 down, closing switch 118 thus starting motor 47. This starts the rotation of shaft 98 carrying the worm 53 and the tripple cam 100, 102 and 104. At the same time the clutch arm releases the bell crank arm from projection 112 and spring 88 tends to pull the bell crank to the right. This causes cam follower 82 to ride out onto cam lobe 102 as quickly as the low point on the cam is reached. Now as the cam rotates further, the bell crank is forced to rotate in a counterclockwise manner causing the stud 86 to rotate the platen clockwise against the action of spring 90, releasing the paper. At the same time 84 pushes upwardly on sprocket 94 advancing it one tooth. Bar 96 which is attached to the platen presses upwardly on the bottom of pawl 37 against the action of spring 65, causing the lower face 70 of the pawl to engage worm 53 as is shown in FIG. 11. As soon as cam follower 82 reaches the high point of lobe 102, spring 88 will cause the follower to ride out onto the high concentric portion 104 of the cam and it will continue to ride on 104 until the bell crank is moved to the left as is later described. Now, as worm 53 continues to rotate, the carriage will be drawn to the left against the action of spring 96. As the carriage approaches the left hand limit of its path of travel, projection 126 on carriage 27 engages a collar 128 on bell crank shaft 80 which moves the bell crank assembly to the left, causing the cam follower 82 to come into contact with the low concentric portion 100 of the cam. At the same time this rotation releases the platen so that it comes back into pressure relationship with the paper and printing head and also releases the pressure on the bottom of pawl 37 so that it rotates counterclockwise, bringing the lower face 70 out of contact with the worm and causing one of the upper faces of the pawl to engage a tooth on the rack. Also, at this time clutch arm 102 is cleared by projection 112 causing its end to catch on projection 112 which opens switch 118 and shuts off the motor. The carriage is now in its left hand position ready for printing another line.

The usual logic circuits in a calculator or the like supply the alternate pulses for pulsing the solenoids 43 and 45. In addition, the logic circuit ordinarily provides a line feed pulse at the end of a printed line or, alternately, switch 124 can be mechanically activated by the carriage as it reaches its right hand limit of the path of travel. Although it has been assumed that the carriage will be returned and the paper advanced at the right hand side of the path of travel, the carriage can be returned from any position when switch 124 is closed. In fact, in some instances it may be desirable to advance the paper without having the carriage traverse as would be the case when there is multiple spacing between printed lines. Thus, if switch 124 is closed (i.e., a pulse supplied by the logic circuit) the paper will be advanced even if the carriage is in its left hand position.

Although certain specific constructions have been shown it will be obvious to those skilled in the art that many variations can be made on the exact mechanism shown.

I claim:

1. A mechanism for carrying a thermal printer head or the like comprising in combination:

a. a frame having a slideably mounted carriage with a printing head thereon adapted to slide from a first side of said frame to the second side of said frame and return, b. said printing head being adapted to print when traversing from said first side to said second side and to not print when being returned from said second side to said first side, c. spring means for biasing said carriage from the first side of the frame to the second side of the frame, d. escapement means for permitting said carriage to move by the action of said spring against said escapement means from the first side of the carriage to the second side of the carriage, said escapement means including a rack lying parallel to the path of travel of said carriage and pivot means on said rack whereby said rack can be rotated from a first position to a second position, e. means for rotating said rack from said first position to said second position, f. a first pawl mounted on said carriage, said pawl having a first tooth adapted to engage said rack when said rack is in the first position, and a second tooth adapted to engage said rack when said rack is in said second position, said rack and pawl means permitting said carriage to move stepwise through its path of travel from the first side of said frame to the second side of said frame as said rack is moved from the first position to said second position, g. power means for returning said carriage from the second side of said frame to the first side of said frame, said power means including a worm extending from one side of said frame to the other and a second pawl on said carriage whereby said second pawl can engage said worm and said worm will move said carriage against said spring, moving said carriage to its opposite limit of travel, h. means for rotating said worm, i. said worm having a cam thereon, said cam having three faces, namely, a low concentric face, a cam lobe and a high concentric face, j. a cam follower riding on said low concentric face while said carriage moves stepwise through its path of travel, and k. means to shift said cam follower to said lobe, whereby said cam follower rises on said lobe to the high concentric face, engaging said second pawl with said worm, whereby the carriage is caused to reverse its path of travel.

* * * * *